US005198095A

United States Patent [19]

Urakawa et al.

[11] Patent Number: 5,198,095

[45] Date of Patent: Mar. 30, 1993

[54] METHOD FOR CONTINUOUSLY MANGANESE-ELECTROPLATING OR MANGANESE-ALLOY-ELECTROPLATING STEEL SHEET

[75] Inventors: Takayuki Urakawa; Yoshiharu Sugimoto, both of Tokyo, Japan

[73] Assignee: NKK Corporation, Tokyo, Japan

[21] Appl. No.: 743,407

[22] Filed: Aug. 13, 1991

[30] Foreign Application Priority Data

Dec. 29, 1989 [JP] Japan ..... 1-344598
Dec. 28, 1990 [WO] PCT Int'l Appl. ... PCT/JP90/01738

[51] Int. Cl.[5] ..... C25D 7/06
[52] U.S. Cl. ..... 205/138
[58] Field of Search ..... 205/138

[56] References Cited

U.S. PATENT DOCUMENTS 4,269,904 5/1981 Ikeno et al. .
4,900,406 2/1990 Janssen ..... 204/206

FOREIGN PATENT DOCUMENTS 57-101685 6/1982 Japan .
58-34300 7/1983 Japan .
59-76899 5/1984 Japan .
62-44598 2/1987 Japan .

*Primary Examiner*—T. M. Tufariello
*Attorney, Agent, or Firm*—Frishauf, Holtz, Goodman & Woodward

[57] ABSTRACT

A method for continuously manganese-electroplating or manganese-alloy-electroplating a steel sheet, which comprises the steps of: using a manganese electroplating solution or a manganese alloy electroplating solution, using an insoluble anode, and causing a DC electric current to flow between the insoluble anode and a steel sheet during travelling through the electroplating solution while replenishing the manganese electroplating solution or the manganese alloy electroplating solution with manganese ions or manganese alloy ions, thereby forming a manganese plating layer or a manganese alloy plating layer on at least one surface of the steel sheet. As the insoluble anode, a hydrogen gas diffusing insoluble anode is used. By continuously supplying a hydrogen gas to the hydrogen gas diffusing insoluble anode, an oxidation reaction of the hydrogen gas is caused to take place at the hydrogen gas diffusing insoluble anode, thereby preventing the production of multivalent manganese in the solid state or the ionic state and having at least trivalence in the manganese electroplating solution or the manganese alloy electroplating solution.

11 Claims, 4 Drawing Sheets

METHOD FOR CONTINUOUSLY MANGANESE-ELECTROPLATING OR MANGANESE-ALLOY-ELECTROPLATING STEEL SHEET

FIELD OF THE INVENTION

The present invention relates to a method for continuously manganese-electroplating or manganese-alloy-electroplating a travelling steel sheet.

BACKGROUND OF THE INVENTION

Manganese is an electrochemically very base metal. Since a continuous manganese-electroplating or manganese-alloy-electroplating of a steel sheet results in the production of a hydrogen gas in a plating solution, a plating efficiency of the manganese-electroplating or the manganese-alloy-electroplating is limited to about 40 to 85%.

When industrially applying the manganese-electroplating or the manganese-alloy-electroplating, manganese ions or manganese alloy ions in the manganese electroplating solution or the manganese alloy electroplating solution are electrochemically reduced into metallic manganese or a metallic manganese alloy, which is taken out the manganese electroplating solution or the manganese alloy electroplating solution, thus causing the decrease in the concentration of manganese ions or manganese alloy ions in the manganese electroplating solution or the manganese alloy electroplating solution. It is thus necessary to keep the concentration of these ions within a certain range. In order to keep a constant concentration of manganese ions or manganese alloy ions in the manganese electroplating solution or the manganese alloy electroplating solution, it is necessary to constantly replenish the manganese electroplating solution or the manganese alloy electroplating solution with manganese ions or manganese alloy ions.

For the purpose of replenishing the electroplating solution with ions of a metal or an alloy for plating when continuously electroplating a steel sheet, a general conventional practice comprises using a metal or an alloy for plating as a soluble anode, and causing a DC electric current to flow between the soluble anode and the steel sheet to be plated, thereby forming a metal plating layer or an alloy plating layer on the surface of the steel sheet.

However, since, when using a metal having a plating efficiency of almost 100% such as copper or zinc as the soluble anode, the amount of metal ions taken out the plating solution for the formation of the plating layer on the surface of the steel sheet is substantially in equilibrium with the amount of metal ions supplied from the soluble anode into the electroplating solution, the concentration of metal ions in the electroplating solution is kept substantially at a constant level.

When using manganese or a manganese alloy as the soluble anode, in contrast, the plating efficiency of manganese or a manganese alloy is so low as 40 to 85% as compared with copper and zinc. Therefore, the amount of manganese ions or manganese alloy ions supplied from the soluble anode into the manganese electroplating solution or the manganese alloy electroplating solution is larger than the amount of manganese ions or manganese alloy ions taken out the manganese electroplating solution or the manganese alloy electroplating solution through the manganese-electroplating or the manganese-alloy-electroplating of the steel sheet. As a result, there occurs the increase in the concentration of manganese ions or manganese alloy ions in the manganese electroplating solution or the manganese alloy electroplating solution.

For this reason, in order to keep a constant concentration of manganese ions or manganese alloy ions in the plating solution, it is necessary to reject part of the plating solution from the plating tank, add water to the plating tank to dilute the plating solution, and thus to reduce the concentration of manganese ions or manganese alloy ions. This requires not only a waste of the expensive plating solution, but also a cost for rejecting the plating solution, thus making it economically unfeasible to practice this plating.

Therefore, when continuously manganese-electroplating or manganese-alloy-electroplating a steel sheet, an insoluble anode must be used.

However, manganese ions are usually present in the divalent form ($Mn^{2+}$) in many cases in a manganese electroplating solution or a manganese alloy electroplating solution. When the plating solution contains a complexing agent, however, manganese ions are sometimes present in the form of trivalent or higher complex ions in the plating solution. When the manganese-electroplating or the manganese-alloy-electroplating is carried out with the use of an insoluble anode, the divalent manganese ions ($Mn^{2+}$) are oxidized on the surface of the insoluble anode into trivalent or higher manganese ions in the solid state or the ionic state.

Manganese ions in the solid state and having at least trivalence are more oxidized into such a solid oxide as $MnO_2$ or $Mn_2O_3$, which are precipitated in the manganese electroplating solution or the manganese alloy electroplating solution, largely impairing the operating efficiency, forming an obstacle for the plating operation, and causes flaws on the manganese plating layer or the manganese alloy plating layer formed on the surface of the steel sheet, thus degrading the merchantability of the plated product. Manganese ions not taking the form of the solid oxides and having at least trivalence in the ionic state dissolve, on the other hand, the manganese plating layer or the manganese alloy plating layer formed on the surface of the steel sheet, accelerate the production of a hydrogen gas at the cathode, thus deteriorating the electrolytic efficiency, reducing the plating efficiency, and seriously degrading the productivity.

It is therefore necessary to remove these oxidized manganese (manganese in the solid state or in the ionic state and having at least trivalence is hereinafter referred to as "multivalent manganese") from the plating solution.

As a means to solve the above-mentioned problems, there is known a method for removing multivalent manganese produced in a manganese-zinc alloy electroplating solution by contact-reducing said multivalent manganese with the use of metallic zinc or metallic manganese into divalent manganese ions ($Mn^{2+}$).

For example, Japanese Patent Provisional Publication No. 62-44,598 discloses a method for removing multivalent manganese produced in an electroplating solution, which comprises:

removing, when electroplating a steel sheet in a manganese-zinc alloy electroplating solution comprising manganese sulfate and zinc sulfate as main components and citric salt as a complexing agent, multivalent manganese having at least trivalence produced in said electroplating solution through the contact-reduction of said multivalent manganese with the use of at least one of metallic zinc and metallic manganese into divalent manganese ions ($Mn^{2+}$), thereby recovering said plating solution (hereinafter referred to as the "prior art 1").

The above-mentioned prior art 1 is a technique useful for removal by reduction of multivalent manganese in the ionic state produced in a manganese-zinc alloy electroplating solution, and in addition, industrially favorable in that it is not necessary to install special facilities for the reduction of multivalent manganese.

The prior art 1 has however the following problems.

The production of multivalent manganese in the manganese-zinc alloy electroplating solution cannot be prevented by the prior art 1. Furthermore, the prior art 1 is practically inconvenient in that the reaction for reduction-removing multivalent manganese in the solid state in the manganese-zinc alloy electroplating solution proceeds only at a low reaction rate because it is an intersolidus reaction and it takes much time to remove multivalent manganese.

As a means to solve the above-mentioned problems, there is known a method for reducing multivalent manganese produced in a manganese electroplating solution or a manganese alloy electroplating solution, by means of a hydrogen gas with palladium (Pd) as a catalyst, into divalent manganese ions ($Mn^{2+}$).

For example, Japanese Patent Provisional Publication No. 59-76,899 discloses a method for reducing multivalent manganese produced in an electroplating solution, which comprises:

reducing, when manganese-electroplating a metallic material in a manganese electroplating solution containing divalent manganese ions ($Mn^{2+}$), multivalent manganese having at least trivalence produced through oxidation of manganese ions ($Mn^{2+}$) in said electroplating solution by means of a hydrogen gas activated by palladium or a palladium alloy (hereinafter referred to as the "prior art 2").

The above-mentioned prior art 2 has the following problems.

The production of multivalent manganese in the manganese electroplating solution cannot be prevented by the prior art 2. It is necessary, in the prior art 2, to use expensive palladium as the catalyst, consume a hydrogen gas which is not usually used for the manganese-electroplating or the manganese-alloy-electroplating, and install facilities for the reduction of multivalent manganese. The prior art 2 is uneconomical and industrially disadvantageous in that the cost for installing such facilities is required.

Both the above-mentioned prior arts 1 and 2 are to reduce multivalent manganese produced in the manganese electroplating solution or the manganese alloy electroplating solution into divalent manganese ions.

Under such circumstances, when using a manganese electroplating solution or a manganese alloy electroplating solution, using an insoluble anode, and causing a DC electric current to flow between the insoluble anode and a steel sheet during travelling through the electroplating solution while replenishing the manganese electroplating solution or the manganese alloy electroplating solution with manganese ions or manganese alloy ions, thereby forming a manganese plating layer or a manganese alloy plating layer on at least one surface of the steel sheet, there is a strong demand for the development of a method which does not cause the production of multivalent manganese in the manganese electroplating solution or the manganese alloy electroplating solution, but such a method has not as yet been proposed.

SUMMARY OF THE INVENTION

An object of the present invention is therefore, when using a manganese electroplating solution or a manganese alloy electroplating solution, using an insoluble anode, and causing a DC electric current to flow between the insoluble anode and a steel sheet during travelling through the electroplating solution while replenishing the manganese electroplating solution or the manganese alloy electroplating solution with manganese ions or manganese alloy ions, thereby forming a manganese plating layer or a manganese alloy plating layer on at least one surface of the steel sheet, to provide a method, which prevents the production of multivalent manganese caused by the oxidation of divalent manganese ions ($Mn^{2+}$) in the manganese electroplating solution or the manganese alloy electroplating solution, thereby improving the plating efficiency and the operating efficiency, largely reducing the manufacturing cost, and forming a manganese plating layer or a manganese alloy plating layer excellent in quality on the surface of the steel sheet.

In accordance with one of the features of the present invention, in a method for continuously manganese-electroplating or manganese-alloy-electroplating a steel sheet, which comprises the steps of:

using a manganese electroplating solution or a manganese alloy electroplating solution, using an insoluble anode, and causing a DC electric current to flow between said insoluble anode and a steel sheet during travelling through said electroplating solution while replenishing said manganese electroplating solution or said manganese alloy electroplating solution with manganese ions or manganese alloy ions, thereby forming a manganese plating layer or a manganese alloy plating layer on at least one surface of said steel sheet;

there is provided the improvement wherein:

a hydrogen gas diffusing insoluble anode is used as said insoluble anode, and a hydrogen gas is continuously supplied to said hydrogen gas diffusing insoluble anode to cause an oxidation reaction of said hydrogen gas at said hydrogen gas diffusing insoluble anode, thereby preventing the production of multivalent manganese in the solid state or the ionic state and having at least trivalence in said manganese electroplating solution or said manganese alloy electroplating solution.

DETAILED DESCRIPTION OF PREFERRED EMBODIMENTS

Figure 1:
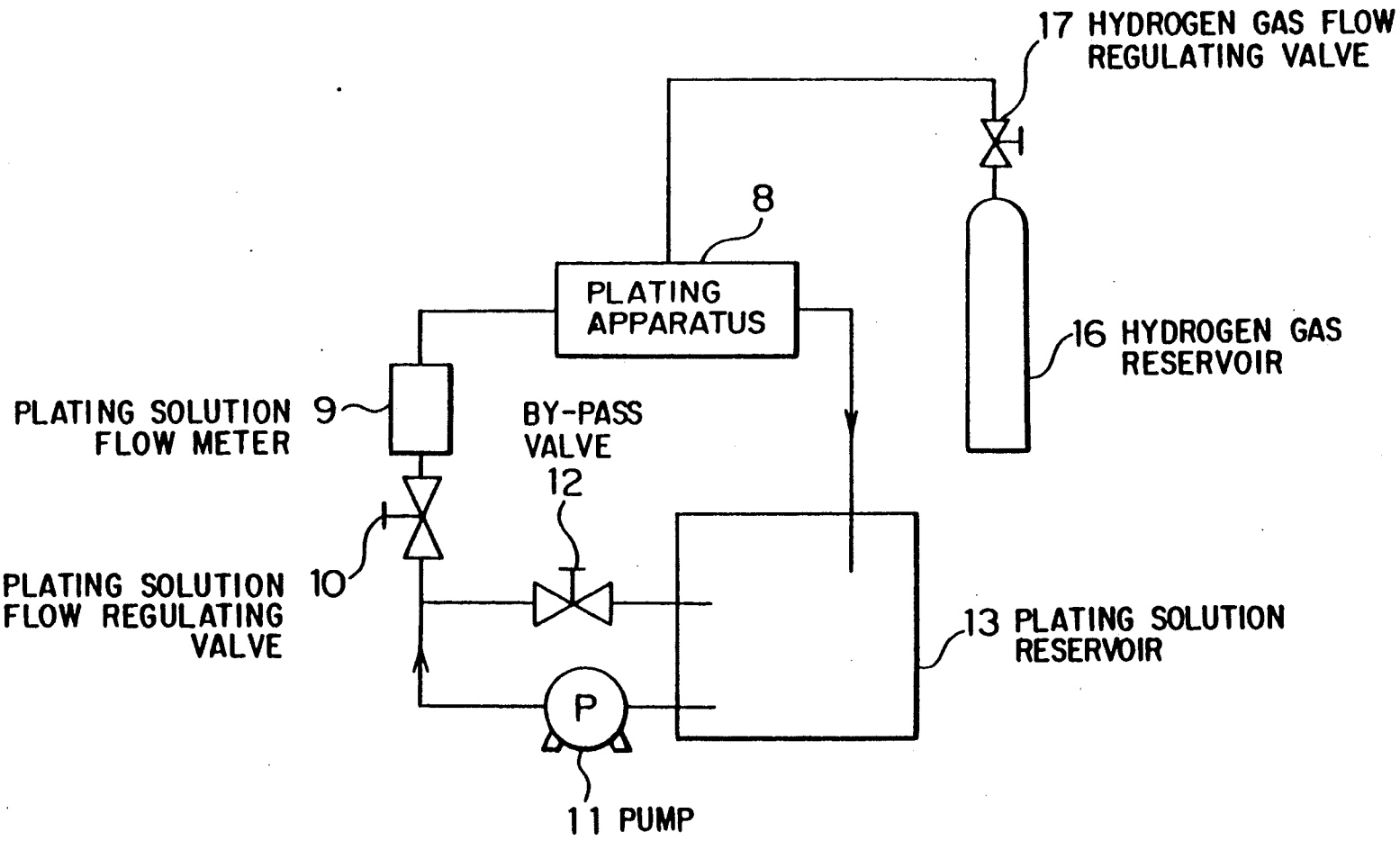
FIG. 1 is a flow diagram illustrating an embodiment of the apparatus for the application of the method of the present invention.

When using a manganese electroplating solution or a manganese alloy electroplating solution, using an insoluble anode, and causing a DC electric current to flow between the insoluble anode and a steel sheet during travelling through the electroplating solution while replenishing the manganese electroplating solution or the manganese alloy electroplating solution with manganese ions or manganese alloy ions, thereby forming a manganese plating layer or a manganese alloy plating layer on the surface of the steel sheet, if a conventional insoluble anode which comprises, for example, a substrate comprising tantalum and a platinum film formed on the surface of the substrate is employed, an oxygen gas producing reaction caused by the decomposition of water as shown by the following formula (1) takes place in the manganese electroplating solution or the manganese alloy electroplating solution, as the oxidation reaction taking place at the anode (hereinafter referred to as the "anodic reaction"):

$$H_2O = \frac{1}{2}O_2 + 2H^+ + 2e^- \quad (1)$$

where the electric potential ($E^0$) is 1.23 V, i.e.:

$E^0 = 1.23$ V.

In order to cause the anodic reaction shown in the fomula (1) at a rate necessary for the electroplating, i.e., at a rate corresponding to the electric current density, it is necessary to add an oxygen producing overvoltage intrinsic to the material used for the anode to 1.23 V. The anodic potential of the insoluble anode upon the electroplating is, depending upon also the plating conditions including the anodic current density and the temperature of the plating solution, higher by several hundred mV to several V than 1.23 V.

Therefore, when using a manganese electroplating solution or a manganese alloy electroplating solution, using an insoluble anode, and causing a DC electric current to flow between the insoluble anode and a steel sheet during travelling through the electroplating solution while replenishing the manganese electroplating solution or the manganese alloy electroplating solution with manganese ions or manganese alloy ions, thereby forming a manganese plating layer or a manganese alloy plating layer on the surface of the steel sheet, divalent manganese ions ($Mn^{2+}$) present in the manganese electroplating solution or the manganese alloy electroplating solution are converted into multivalent manganese through oxidation caused by the reactions as shown in the following formulae (2), (3) and (4):

$$Mn^{2+} + 2H_2O = MnO_2 + 4H^+ 2e^- \quad (2)$$

where the electric potential is 1.23 V, i.e.:

$E^0 = 1.23$ V;

$$Mn^{2+} = Mn^{3+} + e^- \quad (3)$$

where the electric potential is 1.51 V, i.e.:

$E^0 = 1.51$ V;

$$Mn^{2+} + 4H_2O = MnO_4^- + 8H^+ 5e^- \quad (4)$$

where the electric potential is 1.51 V, i.e.:

$E^0 = 1.51$ V.

As described above, since the anodic potential in the manganese electroplating solution or the manganese alloy electroplating solution is higher by several hundred mV to several V than 1.23 V when the conventional insoluble anode is employed, the oxidation reactions of divalent manganese ions ($Mn^{2+}$) as shown in the formulae (2), (3) and (4) may easily take place on the surface of the insoluble anode.

In a method which comprises, for example, using a manganese-zinc alloy electroplating solution comprising sodium citrate, manganese sulfate (monohydrate) and zinc sulfate (septihydrate), using a conventional insoluble anode comprising a substrate comprising tantalum and a platinum film formed on the surface of the substrate, and forming a manganese-zinc alloy plating layer on a steel sheet, multivalent manganese in the ionic state is produced through the oxidation reactions of divalent manganese ions ($Mn^{2+}$) as shown in the formula (3) or (4).

In another method which comprises, for example, using a manganese-zinc alloy electroplating solution comprising manganese borofluoride, zinc borofluoride, boric acid and polyethylene glycol, using the above-mentioned conventional insoluble anode, and forming a manganese-zinc alloy plating layer on a steel sheet, a solid manganese oxide ($MnO_2$) is produced on the surface of the insoluble anode through the oxidation reaction of divalent manganese ions ($Mn^{2+}$) as shown in the formula (2). Furthermore, an oxygen gas produced at the insoluble anode oxidizes, because of its strong oxidizing ability, divalent manganese ions ($Mn^{2+}$) to produce multivalent manganese in the ionic state.

Since the reactions of decomposing water and producing an oxygen gas always take place with a conventional insoluble anode, as described above, multivalent manganese is inevitably produced in this case.

Extensive studies were therefore carried out to prevent the production of multivalent manganese at an insoluble anode when continuously manganese-electroplating or manganese-alloy-electroplating a steel sheet by the use of the insoluble anode. As a result, the following findings were obtained: By continuously supplying a hydrogen gas to an insoluble anode to cause the oxidation reaction of the hydrogen gas at the insoluble anode, it is possible to remarkably reduce the anodic potential so as to inhibit the production of an oxygen gas at the insoluble anode, thereby preventing the oxidation of divalent manganese ions ($Mn^{2+}$) in the electroplating solution into multivalent manganese in the solid state or the ionic state.

The present invention was made on the basis of the above-mentioned findings.

Now, the method of the present invention for continuously manganese-electroplating or manganese-alloy-electroplating a steel sheet is described with reference to the drawings.

In order to prevent the production of multivalent manganese in the method of the present invention, the occurrence is inhibited of the oxygen gas producing reaction which is the cause of the production of multivalent manganese. This is achieved by the use of a hydrogen gas diffusing insoluble anode for causing the oxidation reaction of a hydrogen gas as expressed by the following formula (5):

$$H_2 \rightarrow 2H^{30} + 2e^- \quad (5)$$

where the electric potential is 0.00 V, i.e.:

$E^0 = 0.00$ V.

The oxidation reaction expressed by the formula (5) proceeds with a very small overvoltage by using a hydrogen gas diffusing insoluble anode having a platinum (Pt) or palladium (Pd) catalyst. Even when causing electric current to flow at an electric current density which is industrially employed in the usual manganese-electroplating or manganese-alloy-electroplating, therefore, the anode potential is maintained within a range of from about 0.1 V to about 0.2 V. The anodic potential causing the oxidation reactions of divalent manganese ions ($Mn^{2+}$) as expressed by the formulae (2), (3) and (4) is not therefore reached, and thus multivalent manganese is not produced in the electroplating solution.

Since an oxygen gas, which produces multivalent manganese, is not produced in the electroplating solution, multivalent manganese is never produced. More particularly, in the method of the present invention, the oxidation reaction of a hydrogen gas shown in the formula (5) is used as the anodic reaction, and a hydrogen gas diffusing insoluble anode is employed as the insoluble anode for causing such an oxidation reaction of the hydrogen gas. The hydrogen gas diffusing anode is now considered for the application thereof in a phosphate type fuel battery.

Figure 2:
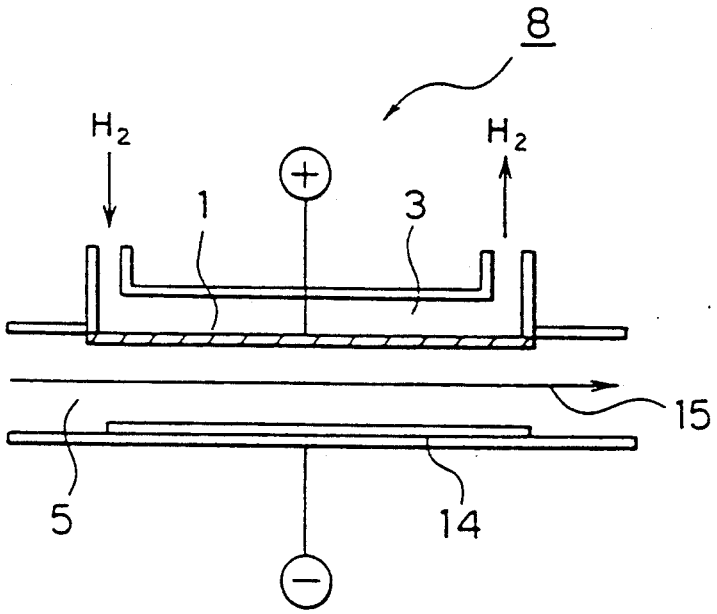
FIG. 2 is a schematic sectional view illustrating the plating apparatus shown in FIG. 1.
Figure 3:
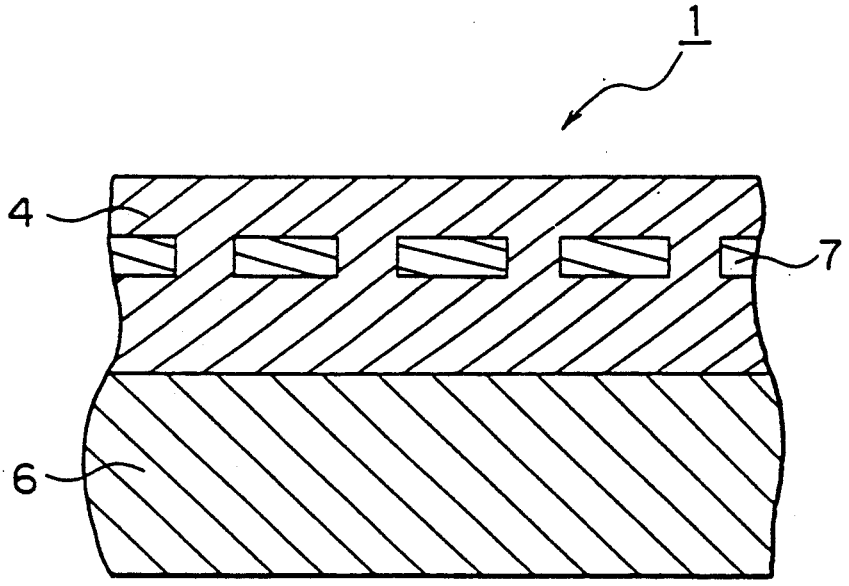
FIG. 3 is a partially enlarged sectional view illustrating the insoluble anode shown in FIG. 2.
Figure 4:
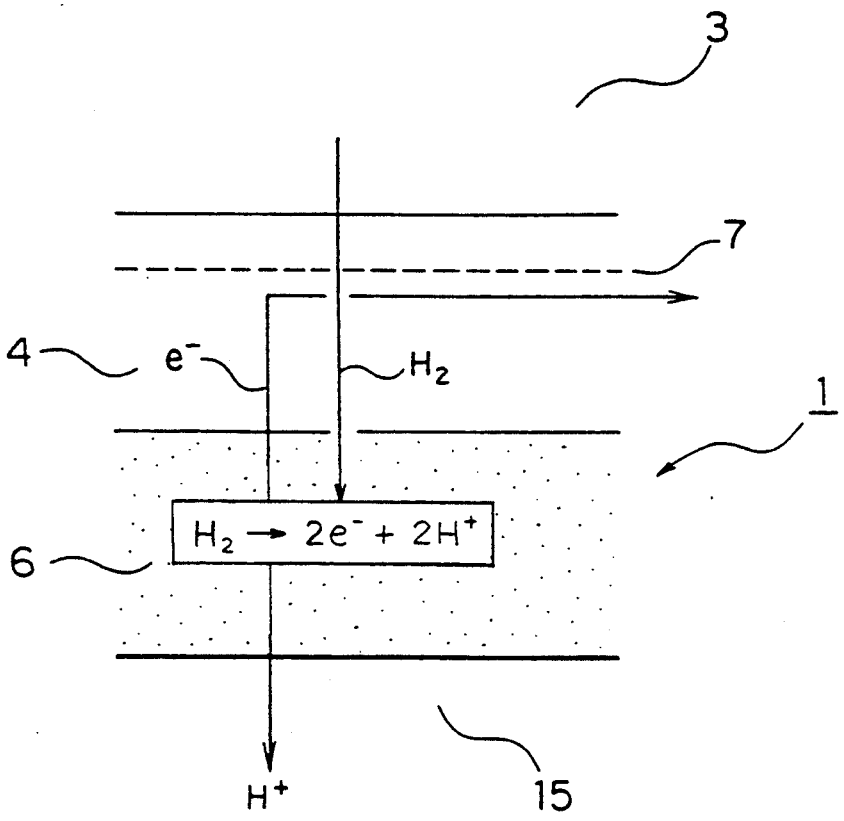
FIG. 4 is a descriptive view illustrating the oxidation reaction of a hydrogen gas at the insoluble anode used in the present invention.

FIG. 1 is a flow diagram illustrating an embodiment of the apparatus for the application of the method of the present invention; FIG. 2 is a schematic sectional view illustrating the plating apparatus shown in FIG. 1; FIG. 3 is a partially enlarged sectional view illustrating the insoluble anode shown in FIG. 2; and FIG. 4 is a descriptive view illustrating the oxidation reaction of a hydrogen gas at the insoluble anode used in the present invention.

An electroplating solution circulates within the apparatus in the arrow direction in FIG. 1 during the electroplating operation under the action of a pump 11. Also in FIG. 1, 12 is a by-pass valve which is opened upon the stoppage of the operation of the pump 11; 8 is a plating apparatus; 13 is a plating solution reservoir; 10 is a plating solution flow regulating valve; 9 is a plating solution flow meter; 16 is a hydrogen gas reservoir; and 17 is a hydrogen gas flow regulating valve. In FIG. 2, 8 is the plating apparatus; 5 is a plating tank; 3 is a hydrogen gas chamber; 1 is a hydrogen gas diffusing insoluble anode; and 14 is a steel sheet to be electroplated. Replenishing of ions of a metal for plating is accomplished in the plating solution reservoir 13. The hydrogen gas diffusing insoluble anode 1 is secured to the upper portion of the plating tank 5, and the steel sheet 14 continuously travels on the bottom portion of the plating tank 5. A hydrogen gas is supplied from the hydrogen gas reservoir 16 to the hydrogen gas chamber 3. As shown in FIGS. 3 and 4, the hydrogen gas diffusing insoluble anode 1 comprises a porous water-repellent layer 4 having a mesh-shaped electric-conductive substrate 7 in the interior thereof, and a reaction layer 6 formed on one surface of the porous water-repellent layer 4. The porous water-repellent layer 4 is positioned on the side facing the hydrogen gas chamber 3, and the reaction layer 6 is positioned on the side facing the plating tank 5. The mesh-shaped electric-conductive substrate 7 comprises a mesh-shaped copper sheet. The porous water-repellent layer 4 comprises a mixture of hydrophobic carbon black and polytetrafluoroethylene. The reaction layer 6 comprises a mixture of hydrophilic carbon black, polytetrafluoroethylene and platinum.

In the hydrogen gas diffusing insoluble anode 1, a hydrogen gas ($H_2$) diffuses into the porous water-repellent layer 4 from the side facing the hydrogen gas chamber 3, is converted into hydrogen ions ($H^+$) through the oxidation reaction shown in the formula (5):

$$H_2 \rightarrow 2H^+ + 2e^- \quad (5)$$

under the effect of platinum as the catalyst in the reaction layer 6, and further diffuses into the electroplating solution 15. Electrons ($e^-$) flows through the mesh-shaped electric-conductive substrate 7 and an external power source not shown to the steel sheet 14, and reduces metal ions and hydrogen ions at the steel sheet 14, thereby electroplating same.

Now, the method of the present invention is described further in detail by means of examples while comparing with examples for comparison.

EXAMPLE 1

Using the apparatus shown in FIGS. 1 and 2, and using the hydrogen gas diffusing insoluble anode 1 shown in FIGS. 3 and 4, a manganese-zinc-alloy-electroplating was applied to one surface of a steel sheet 14 having a thickness of 0.2 mm, without causing same to travel. The chemical composition of the manganese-zinc alloy electroplating solution used and the plating conditions are shown in Table 1. The production of multivalent manganese relative to the plating time and the plating voltage, and the external appearance of the manganese-zinc alloy plating layer formed on the surface of the steel sheet 14 were investigated. The results are shown in Table 2 under the index of "Example 1". For comparison purposes, using an insoluble anode comprising a tantalum substrate and a platinum film formed on the surface of the substrate, in place of the hydrogen gas diffusing insoluble anode 1 used in the Example 1, a manganese-zinc-alloy-electroplating was applied to one surface of a steel sheet 14 having a thickness of 0.2 mm with the same chemical composition of the electroplating solution and under the same plating conditions as in the Example 1. The production of multivalent manganese relative to the plating time and the plating voltage, and the external appearance of the manganese-zinc alloy plating layer formed on the surface of the steel sheet 14 were investigated. The results are shown also in Table 2 under the index of "Example for comparison 1".

TABLE 1

| | | | |
|---|---|---|---|
| Chemical composition of plating solution | Manganese borofluoride | 270 | g/l |
| | Zinc borofluoride | 20 | g/l |
| | Boric acid | 20 | g/l |
| | Polyethylene glycol | 2 | g/l |
| Plating conditions | Electric current density | 70 | $A/dm^2$ |
| | Plating solution temperature | 55° | C. |
| | Plating solution pH | 3 | |
| | Plating solution quantity | 50 | l |
| | Plating solution flow velocity | 2 | m/sec. |
| | Cathode area, Anode area | 1.2 | $dm^2$ (both) |

TABLE 2

| | Plating time (minute) | Multivalent manganese produced: On anode surface | Multivalent manganese produced: In plating solution | Plating voltage (V) | External appearance of plating layer |
|---|---|---|---|---|---|
| Example 1 | 5 | None | None | 13 | Metallic gloss |
| | 20 | None | None | 13 | Metallic gloss |
| | 60 | None | None | 13 | Metallic gloss |
| | 180 | None | None | 13 | Metallic gloss |
| Example for comparison 1 | 5 | Produced | Slight | 15 | Metallic gloss |
| | 20 | Produced | Produced | 15 | Grey |
| | 60 | Produced | Much | 15 | Black |
| | 180 | Produced | Much | 15 | Black |

In the Example for Comparison 1 using the insoluble anode comprising the tantalum substrate and the platinum film formed on the surface of the substrate, as shown in Table 2, multivalent manganese ($MnO_2$) was produced on the surface of the insoluble anode after the lapse of five minutes from the start of the electroplating, and the production of multivalent manganese in a slight amount was observed in the plating solution. Twenty minutes after the start of the electroplating, the production of multivalent manganese was observed in considerable amount on the surface of the insoluble anode as well as in the plating solution. Sixty minutes after the start of the electroplating, multivalent manganese began accumulating on the bottom of the plating solution reservoir 13, and 180 minutes after the start of the electroplating, furthermore, multivalent manganese was accumulated in a large amount on the bottom of the plating solution reservoir 13.

The external appearance of the plating layer of the steel sheet 14 in the Example for Comparison 1 was as follows: As shown in Table 2, five minutes after the start of the electroplating, the plating layer showed substantially a metallic gloss with a slight seam-shaped unevenness. Twenty minutes after the start of the electroplating, however, the external appearance of the plating layer presented a grey rough surface. After the lapse of 60 minutes from the start of the electroplating, furthermore, the plating layer showed a black external appearance which was far from being practically applicable.

In the Example 1 using the hydrogen gas diffusing insoluble anode 1, in contrast, as shown in Table 2, no multivalent manganese was observed not only on the surface of the hydrogen gas diffusing insoluble anode 1 but also in the plating solution, and the plating layer showed a metallic gloss even after the lapse of 180 minutes from the start of the electroplating.

In the Example 1, the plating voltage was lower by 2 V than that in the Example for Comparison 1. The reason is that there is difference in the electric potential ($E^0$) between the above-mentioned formulae (1) and (5), and there is only a small overvoltage of the oxidation reaction of the hydrogen gas taking place at the hydrogen gas diffusing insoluble anode 1. It is understood that the Example 1 is more favorable than the Example for Comparison 1 also in terms of the cost of electric power.

EXAMPLE 2

Using the apparatus shown in FIGS. 1 and 2, and using the hydrogen gas diffusing insoluble anode 1 shown in FIGS. 3 and 4, a manganese-zinc-alloy-electroplating was applied to one surface of a steel sheet 14 having a thickness of 0.2 mm, without causing same to travel. The chemical composition of the manganese-zinc alloy electroplating solution used and the plating conditions are shown in Table 3. The production of multivalent manganese relative to the plating time and the plating voltage, the plating efficiency and the amount of decrease in the plating efficiency were investigated. The results are shown in Table 4 under the index of "Example 2". For comparison purposes, using an insoluble anode comprising a tantalum substrate and a platinum film formed on the surface of the substrate, in place of the hydrogen gas diffusing insoluble anode 1 used in the Example 2, a manganese-zinc-alloy-electroplating was applied to one surface of a steel sheet 14 having a thickness of 0.2 mm with the same chemical composition of the electroplating solution and under the same plating conditions as in the Example 2. The production of multivalent manganese relative to the plating time and the plating voltage, the plating efficiency and the amount of decrease in the plating efficiency were investigated. The results are shown also in Table 4 under the index of "Example for comparison 2". In the Example 2 and the Example for Comparison 2, the plating efficiency was 42% immediately after the start of the electroplating.

TABLE 3

| | | |
|---|---|---|
| Chemical composition of plating solution | Manganese sulfate (monohydrate) | 40 g/l |
| | Zinc sulfate (septihydrate) | 70 g/l |
| | Sodium citrate | 180 g/l |
| Plating conditions | Electric current density | 30 A/dm$^2$ |
| | Plating solution temperature | 50° C. |
| | Plating solution pH | 5.6 |
| | Plating solution quantity | 50 l |
| | Plating solution flow velocity | 2 m/sec. |
| | Cathode area, Anode area | 1.2 dm$^2$ (both) |

TABLE 4

| | Plating time (minute) | Multivalent manganese produced: On anode surface | Multivalent manganese produced: In plating solution | Plating voltage (V) | Plating efficiency (%) | Decrease in plating efficiency (%) |
|---|---|---|---|---|---|---|
| Example 2 | 10 | None | None | 12 | 42 | 0 |
| | 40 | None | None | 12 | 42 | 0 |
| | 120 | None | None | 12 | 42 | 0 |
| | 360 | None | None | 12 | 42 | 0 |
| Example for comparison 2 | 10 | None | Slight | 14 | 42 | 0 |
| | 40 | None | Produced | 14 | 41 | 1 |
| | 120 | None | Produced | 14 | 34 | 8 |
| | 360 | None | Produced | 14 | 30 | 12 |

In the Fxample for Comparison 2 using the insoluble anode comprising the tantalum substrate and the platinum film formed on the surface of the substrate, as shown in Table 4, the production of multivalent manganese ($MnO_2$), while not being observed on the surface of the insoluble anode, was observed in the plating solution, and the color of the plating solution changed with time from pink, when not containing multivalent manganese, to brown, and then to dark-brown.

In the Example for Comparison 2, unlike the above-mentioned Example for Comparison 1, multivalent manganese in the solid state was not produced. A conceivable cause is that, because the plating solution contains citric acid in a large amount, oxidation products of manganese ions and citric acid form complex ions which bring about stabilization. However, multivalent manganese in the ionic state was produced in the plating solution, and the thus produced multivalent manganese in the ionic state caused a decrease in the plating efficiency. More specifically, the plating efficiency was decreased by 8% after the lapse of 120 minutes from the start of the electroplating, and was decreased by as much as 12% after the lapse of 360 minutes from the start of the electroplating, thus posing a serious practical problem.

In the Example 2 using the hydrogen gas diffusing insoluble anode 1, in contrast, as shown in Table 4, the production of multivalent manganese was not observed not only on the surface of the hydrogen gas diffusing insoluble anode 1 but also in the plating solution, and there was no decrease in the plating efficiency.

In the Example 2, the plating voltage was lower by 2 V than that in the Example for Comparison 2. The reason is that there is a difference in the electric potential ($E^0$) between the above-mentioned formulae (1) and (5), and there is only a small overvoltage of the oxidation reaction of the hydrogen gas taking place at the hydrogen gas diffusing insoluble anode 1. It is understood that the Example 2 is more advantageous than the Example for Comparison 2 also in terms of the cost of electric power.

EXAMPLE 3

Using the apparatus shown in FIGS. 1 and 2, and using the hydrogen gas diffusing insoluble anode 1 shown in FIGS. 3 and 4, a manganese-electroplating was applied to one surface of a steel sheet 14 having a thickness of 0.2 mm, without causing same to travel. The chemical composition of the manganese electroplating solution used and the plating conditions are shown in Table 5. The production of multivalent manganese relative to the plating time and the plating voltage, the plating efficiency and the amount of decrease in the plating efficiency were investigated. The results are shown in Table 6 under the index of "Example 3". For comparison purposes, using an insoluble anode comprising a tantalum substrate and a platinum film formed on the surface of the substrate, in place of the hydrogen gas diffusing insoluble anode 1 used in the Example 3, a manganese-electroplating was applied to one surface of a steel sheet 14 having a thickness of 0.2 mm with the same chemical composition of the electroplating solution and under the same plating conditions as in the Example 3. The production of multivalent manganese relative to the plating time and the plating voltage, the plating efficiency and the amount of decrease in the plating efficiency were investigated. The results are shown also in Table 6 under the index of "Example for comparison 3". In the Example 3 and the Example for Comparison 3, the plating efficiency was 61% immediately after the start of the electroplating.

TABLE 5

| | | |
|---|---|---|
| Chemical composition of plating solution | Manganese sulfate (monohydrate) | 100 g/l |
| | Ammonium sulfate | 60 g/l |
| | Ammonium thiocyanate | 50 g/l |
| Plating conditions | Electric current density | 50 A/dm$^2$ |
| | Plating solution temperature | 50° C. |
| | Plating solution pH | 3 |
| | Plating solution quantity | 50 l |
| | Plating solution flow velocity | 2 m/sec. |
| | Cathode area, Anode area | 1.2 dm$^2$ (both) |

TABLE 6

| | Plating time (minute) | Multivalent manganese produced: On anode surface | Multivalent manganese produced: In plating solution | Plating voltage (V) | Plating efficiency (%) | Decrease in plating efficiency (%) |
|---|---|---|---|---|---|---|
| Example 3 | 5 | None | None | 15 | 61 | 0 |
| | 20 | None | None | 15 | 61 | 0 |
| | 60 | None | None | 15 | 61 | 0 |
| | 180 | None | None | 15 | 61 | 0 |
| Example for comparison 3 | 5 | Produced | Produced | 17 | 50 | 11 |
| | 20 | Produced | Much | 17 | 42 | 19 |
| | 60 | Produced | Much | 17 | 35 | 26 |
| | 180 | Produced | Much | 17 | 30 | 31 |

(Note)
The plating efficiency being 61% immediately after the start of electroplating.

In the Example for Comparison 3 using the insoluble anode comprising a tantalum substrate and the platinum film formed on the surface of the substrate, as shown in Table 6, multivalent manganese ($MnO_2$) was produced not only on the surface of the insoluble anode but also in the plating solution after the lapse of five minutes from the start of the electroplating, and the amount of multivalent manganese in the plating solution was increased with time. The amount of multivalent manganese on the surface of the insoluble anode showed almost no change. The reason is that multivalent manganese produced on the surface of the insoluble anode, when growing to a certain thickness, was peeled off and dropped into the plating solution. In the Example for Comparison 3, the plating efficiency was sharply decreased along with the lapse of time. More specifically, the plating efficiency was decreased to about a half that at the start of the electroplating after the lapse of 180 minutes from the start of the electroplating.

In the Example 3 using the hydrogen gas diffusing insoluble anode 1, in contrast, as shown in Table 6, the production of multivalent manganese was not observed not only on the surface of the hydrogen gas diffusing insoluble anode 1 but also in the plating solution, and there was no decrease in the plating efficiency.

In the Example 3, the plating voltage was lower by 2 V than that in the Example for Comparison 3. The reason is that there is a difference in the electric potential ($E^0$) between the above-mentioned formulae (1) and (5), and there is only a small overvoltage of the oxidation reaction of the hydrogen gas taking place at the hydrogen gas diffusing insoluble anode 1. It is understood that the Example 3 is more advantageous than the Example for Comparison 3 also in terms of the cost of electric power.

According to the method of the present invention, as described above in detail, when using a manganese electroplating solution or a manganese alloy electroplating solution, using an insoluble anode, and causing a DC electric current to flow between the insoluble anode and a steel sheet during travelling through the electroplating solution while replenishing the manganese electroplating solution or the manganese alloy electroplating solution with manganese ions or manganese alloy ions, thereby forming a manganese plating layer or a manganese alloy plating layer on at least one surface of the steel sheet, it is possible, by using a hydrogen gas diffusing insoluble anode as the above-mentioned insoluble anode, in which the oxidation reaction of a hydrogen gas takes place and thus the anodic potential is remarkably reduced, to inhibit the production of an oxygen gas at the insoluble anode, thereby preventing the oxidation of divalent manganese ions ($Mn^{2+}$) in the manganese electroplating solution or the manganese alloy electroplating solution into multivalent manganese in the solid state or the ionic state and having at least trivalence, thus forming a manganese plating layer or a manganese alloy plating layer excellent in quality on at least one surface of the steel sheet, and improve the plating efficiency and the plating efficiency, thus providing industrially useful effects.

What is claimed is:

1. A method for continuously electroplating manganese or a manganese alloy on a steel sheet, which comprises the steps of:

causing a DC electric current to flow between a hydrogen gas diffusing insoluble anode (1) and a steel sheet travelling through a manganese electroplating solution or a manganese alloy electroplating solution while replenishing said manganese electroplating solution or said manganese alloy electroplating solution with manganese ions or manganese alloy ions, thereby forming a manganese plating layer or a manganese alloy plating layer on at least one surface of said steel sheet; and continuously supplying a hydrogen gas to said hydrogen gas diffusing insoluble anode (1), while forming said manganese plating layer or said manganese alloy plating layer, to cause an oxidation reaction of said hydrogen gas at said hydrogen gas diffusing insoluble anode (1), thereby preventing the production of at least trivalent manganese in the solid state or the ionic state in said manganese electroplating solution or said manganese alloy electroplating solution; and wherein:

said hydrogen gas diffusing insoluble anode (1) comprises a porous water-repellent layer (4) having a mesh-shaped electric-conductive substrate (7) therein and a reaction layer (6) formed on one surface of said porous water-repellent layer (4), said hydrogen gas is continuously supplied to a side of said porous water-repellent layer (4) of said hydrogen gas diffusing insoluble anode (1), and a side of said reaction layer (6) of said hydrogen gas diffusing insoluble anode (1) is immersed in said manganese electroplating solution or said manganese alloy electroplating solution.

2. The method as claimed in claim 1, wherein said mesh-shaped electric-conductive substrate (7) comprises a copper sheet.

3. The method as claimed in claim 1, wherein said porous water-repellent layer (4) comprises a mixture of carbon black and polytetrafluoroethylene.

4. The method as claimed in claim 2, wherein said porous water-repellent layer (4) comprises a mixture of carbon black and polytetrafluoroethylene.

5. The method as claimed in claim 1, wherein said reaction layer (6) comprises a mixture of carbon black, polytetrafluoroethylene and platinum.

6. The method as claimed in claim 2, wherein said reaction layer (6) comprises a mixture of carbon black, polytetrafluoroethylene and platinum.

7. The method as claimed in claim 3, wherein said reaction layer (6) comprises a mixture of carbon black, polytetrafluoroethylene and platinum.

8. The method as claimed in claim 4, wherein said reaction layer (6) comprises a mixture of carbon black, polytetrafluoroethylene and platinum.

9. The method as claimed in claim 4, wherein said electroplating solution comprises sodium citrate, manganese sulfate and zinc sulfate.

10. The method as claimed in claim 4, wherein said electroplating solution comprises manganese borofluoride, zinc borofluoride, boric acid and polyethylene glycol.

11. The method as claimed in claim 4, wherein said electroplating solution comprises manganese sulfate, ammonium sulfate and ammonium thiocyanate.

* * * * *